United States Patent [19]

Seyler

[11] 4,410,881

[45] Oct. 18, 1983

[54] ELECTRIC HORN WITH MEANS FOR CONTROLLING CURVATURE OF THE STRIKER CARRIER

[75] Inventor: Gerard Seyler, Elgin, Ill.

[73] Assignee: Pittway Corporation, Aurora, Ill.

[21] Appl. No.: 255,869

[22] Filed: Apr. 20, 1981

[51] Int. Cl.[3] ..... G08B 3/10; G10K 9/12

[52] U.S. Cl. ..... 340/388; 340/402

[58] Field of Search ..... 340/388, 392, 402, 404, 340/403; 116/149–171

[56] References Cited

U.S. PATENT DOCUMENTS

| | | | |
|---|---|---|---|
| 2,658,194 | 11/1953 | Kalin et al. | 340/402 |
| 2,952,753 | 9/1960 | Kmiecik et al. | 200/81.9 R |
| 3,188,421 | 6/1965 | Rowell | 200/81.9 R |
| 3,518,667 | 6/1970 | Hanna et al. | 340/388 |
| 3,540,039 | 11/1970 | McCarty, Jr. et al. | 340/392 |
| 3,864,823 | 2/1975 | Berns | 340/402 X |
| 4,075,627 | 2/1978 | Pariza | 340/388 |
| 4,199,752 | 4/1980 | Lucas et al. | 340/388 |

*Primary Examiner*—John W. Caldwell, Sr.

*Assistant Examiner*—Daniel Myer

*Attorney, Agent, or Firm*—Dithmar, Stotland, Stratman & Levy

[57] ABSTRACT

The horn comprises a magnetically permeable housing with an electromagnet mounted therein and a diaphragm attached thereto. The electromagnet core may have an inclined bearing surface at one end thereof. A striker is disposed between the electromagnet bearing surface and the diaphragm for movement away from and strikingly against the diaphragm, the striker being coupled to the housing by a flexible carrier member which is so mounted that when the striker is moving away from the diaphragm there is imparted to the carrier member a predetermined curvature to increase the potential energy thereof. In one form of the invention a control member, either integral with or attached to the housing, has a curved surface engageable with the carrier member to impart the predetermined curvature thereto. The control member may also have a stepped configuration which simulates a curved surface. In still another form of the invention the carrier member rests loosely upon a sloping control surface of the housing.

5 Claims, 9 Drawing Figures

FIG. 5
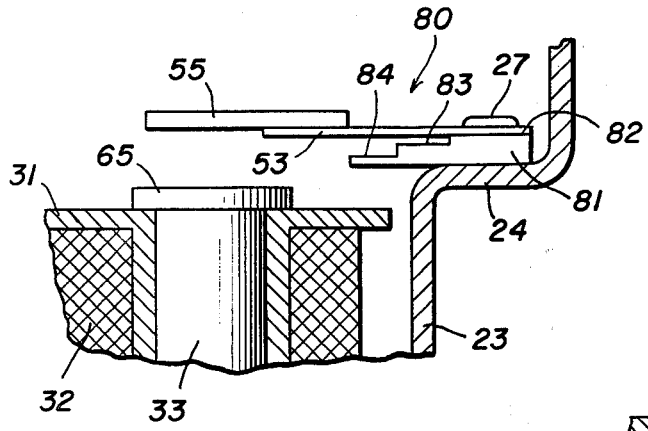
FIG. 6
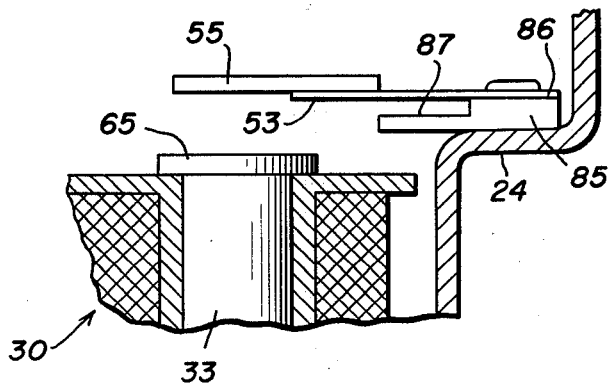
FIG. 9
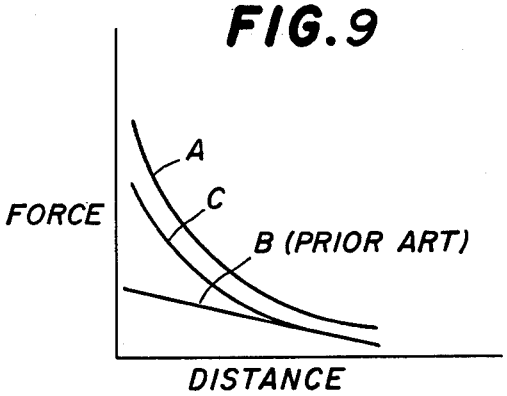
FIG. 7
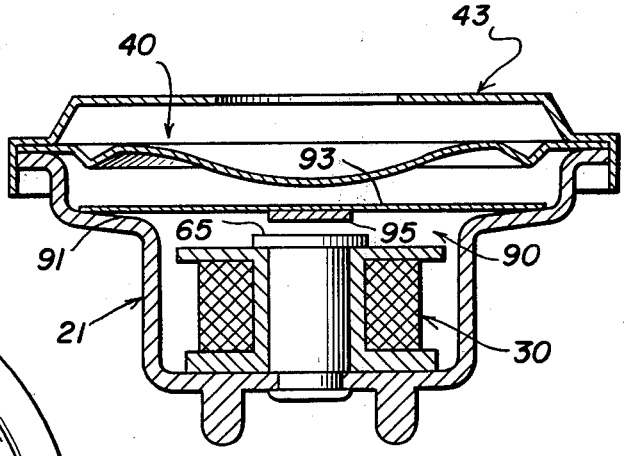
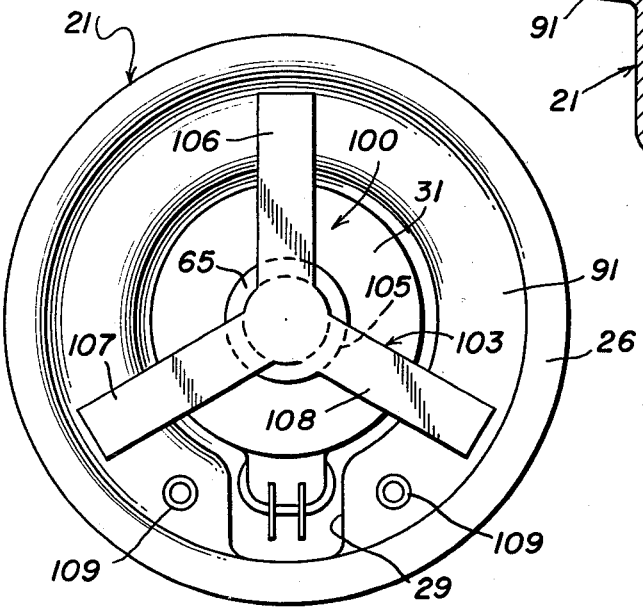
FIG. 8

ELECTRIC HORN WITH MEANS FOR CONTROLLING CURVATURE OF THE STRIKER CARRIER

BACKGROUND OF THE INVENTION

U.S. Pat. No. 4,075,627, assigned to the assignee of the present application, discloses an electric horn comprising a housing, an electromagnet, a diaphragm and a striker disposed between the diaphragm and the electromagnet, and which is mounted on the housing by means of a carrier spring. The shape and means of attachment of the carrier spring are such that when it is drawn toward the electromagnet, its force-deflection characteristic is substantially linear (see, e.g., FIG. 9, Curve B). But the static magnetic force between the electromagnet and the striker is nonlinear, i.e., it increases geometrically as the distance between them decreases. Thus, very little of the energy made available by the electromagnet is converted into potential energy of the carrier spring and is thereby available for producing an acoustic output. The rest of the energy made available by the magnetic circuit is wasted. Consequently, the efficiency of the horn is relatively low.

SUMMARY OF THE INVENTION

It is, therefore, a general object of the present invention to provide an improved electric horn which has increased efficiency.

It is an important object of the present invention to provide an electric horn which controls the deflection of the striker carrier during its movement away from the diaphragm to impart to the carrier a predetermined curvature designed to maximize the potential energy stored therein.

It is another object of this invention to provide an improved electric horn of the type set forth which is characterized by reduced starting voltage.

These and other objects of the invention are achieved by providing an improved horn for generating an audible signal comprising: a housing formed of magnetically permeable material and being open at one end thereof, a diaphragm of relatively flexible material at the one end and attached to the housing, an electromagnet in the housing and attached thereto, control means on the housing including a resilient flexible carrier member, a striker member of magnetically permeable material mounted on the carrier member between the diaphragm and the electromagnet and operatively associated with the electromagnet for movement away from and strikingly against the diaphragm to generate noise, the control means being responsive to movement of the striker member away from the diaphragm for imparting to the carrier member a predetermined curvature for increasing the potential energy thereof.

The invention consists of certain novel features and a combination of parts hereinater fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

FIG. 5 is a view similar to FIG. 4, and illustrating still another embodiment of the present invention;

FIG. 6 is a view similar to FIG. 5, illustrating an alternative version of the embodiment of FIG. 5;

FIG. 7 is a view similar to FIG. 2, illustrating still another embodiment of the present invention;

FIG. 8 is a view similar to FIG. 7, illustrating an alternative version of the embodiment of FIG. 7; and FIG. 9 is a graph plotting forces applied to the striker of the present invention against the distance thereof from the electromagnet.

DETAILED DESCRIPTION OF THE PREFERRED EMBODIMENTS

Figure 1:
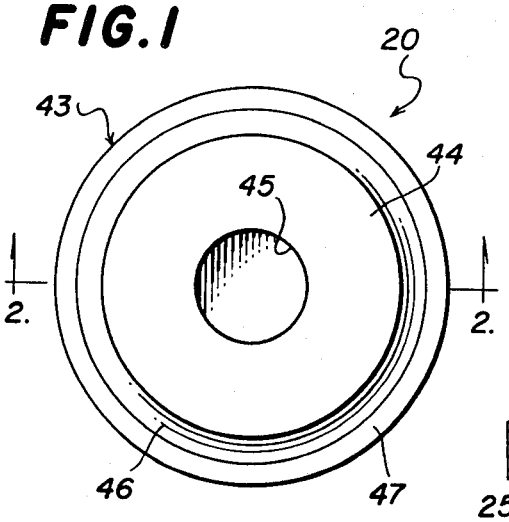
FIG. 1 is a top plan view of an electric horn incorporating the features of the present invention.
Figure 2:
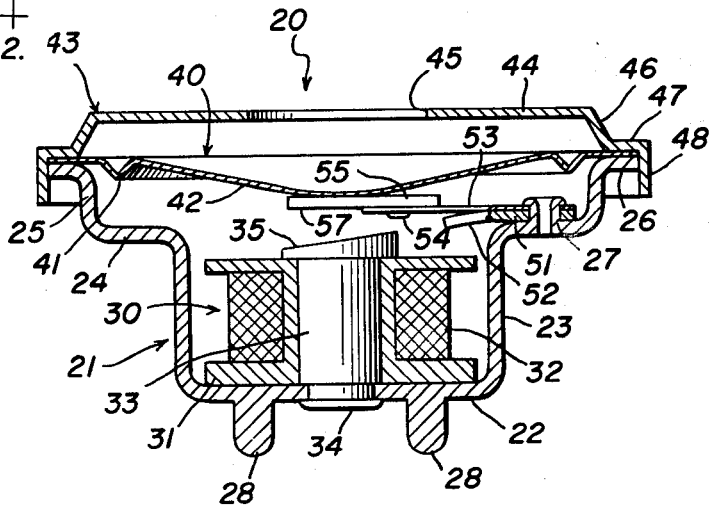
FIG. 2 is an enlarged view in vertical section taken along the line 2—2 of FIG. 1.
Figure 3:
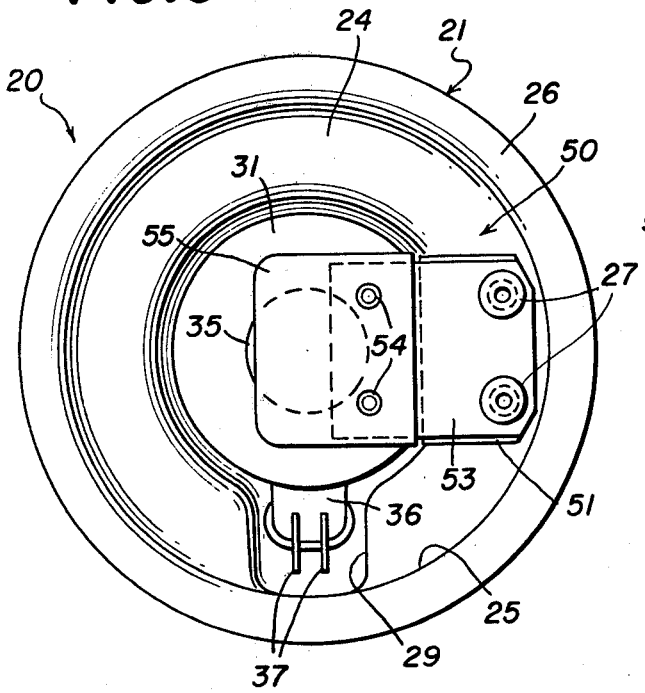
FIG. 3 is an enlarged top plan view of the horn of FIG. 1, with the cover removed.

In FIGS. 1 through 3 of the drawings there is illustrated an electrically operated horn 20 embodying the principles of the present invention, and constructed in accordance with a first embodiment thereof. Such a horn may be used as an audible alarm wherever such alarms are required, but because of its compact and efficient structure, it is particularly suited for use as an audible alarm or sound generator within a fire/smoke detector (not shown).

The horn 20 includes a cup-shaped housing 21 formed of magnetically permeable material. The housing 21 has a circular base 22, a generally cylindrical lower section 23 on the periphery of the base 22, an annular shelf 24 extending radially outwardly from the upper end of the lower section 23, a cylindrical upper section 25 of larger diameter than the lower section 23, and a radially outwardly extending annular lip 26. The shelf 24 carries a pair of upstanding lugs 27. Depending from the base 22 are two mounting tabs 28 which are adapted to fit within matching slots in a printed circuit board with which the horn 20 is used. The tabs 28 are bent over and soldered to secure the horn 20 in place. In a region illustrated at the bottom of FIG. 3, the lower section 23 is not offset from, but instead is a continuation of, the upper section 25, and the shelf 24 is discontinuous in this region, thereby creating a channel 29.

The horn 20 further comprises an electromagnet 30 positioned in the lower section 23 of the housing 21. The electromagnet 30 includes a bobbin 31, a winding 32 and a core 33 of magnetic material located in the bobbin 31. The outer end of the core 33 is staked or rolled over the exterior surface of the base 22, as at 34, to secure the electromagnet 30 within the housing 21. The core 33 is provided with a flat bearing surface 35 at the upper end thereof which is inclined upwardly to the right, as viewed in FIG. 2, at an acute angle to the axis of the electromagnet 30. An extension 36 of the bobbin 31 is located in the channel 29. A pair of L-shaped terminals 37 mounted on the extension 36 have ends that protrude from the housing 21 for electrical connection to the printed circuit board with which the horn 20 is used.

A diaphragm 40 of flexible material, preferably metal, and having a diameter approximately equal to the outer diameter of the lip 26, is circumferentially supported thereon. The diaphragm 40 is formed with a downwardly extending annular ridge 41 spaced from the periphery thereof and a downwardly displaced central portion 42. The diaphragm 40 is held over the housing 21 against the lip 26 by a frustoconical cover 43. The cover 43 includes a circular top 44 having a circular sound-exit port 45 in the center thereof. A side wall 46 extends downwardly and outwardly from the circumference of the top 44 to an annular lip 47. A cylindrical flange 48 extends downwardly from the lip 47 and terminates in a plurality of spaced-apart tabs (not shown) for engaging the lip 26 and securing the cover 43 and the diaphragm 40 thereto.

The electric horn 20 further includes a striker assembly, generally designated by the numeral 50, and which includes a short, generally rectangular control member 51 mounted on the shelf 24 and having a pair of apertures therethrough in which the lugs 27 are respectively received. The control member 51 has a downwardly curved distal end 52 which projects a predetermined distance radially inwardly of the lower section 23. The striker assembly 50 further includes a flat, rectangular, elongated carrier 53 which is flexible and resilient, preferably being constructed of clock steel. The carrier 53 overlies the control member 51 and has two apertures through which the lugs 27 are respectively received, so that the outer end of the carrier 53 is spaced slightly from the upper section 25 of the housing 21. The inner end of the carrier 53 extends radially inwardly of the housing 21 and overlies the electromagnet 30. Fixedly secured to the inner end of the carrier 53, as by rivets 54, is a flat rectangular striker 55 formed of a magnetically permeable material. The striker 55 has a lower bearing surface 57 facing the bearing surface 35 of the core 33, and has an upper surface which is normally resiliently urged into engagement with the central portion 42 of the diaphragm 40.

To operate the horn 20, a source of voltage which may be AC or periodic DC, is connected across the winding 32 by way of terminals 37. A field of magnetic flux is thereby repetitively and intermittently generated through the magnetically permeable media of the coil core 33, the housing 21 and the striker 55, to draw the striker 55 away from the diaphragm 40 against the urging of the carrier 53, and then to release the striker 55 for movement toward and impact against the central portion 42 of the diaphragm 40 under the urging of the carrier 53. With each impact of the striker 55 against the diaphragm 40, a sharp sound is generated for exit externally of the horn 20 both directly through the sound-exit port 45 and through the vibration of horn surfaces.

The control member 51 and the carrier 53 provide a control assembly for the striker 55. More specifically, as the striker 55 is drawn toward the electromagnet core 33, progressively more of the carrier 53 is brought into engagement with the curved upper surface of the control member 51. Thus, as the carrier 53 is deflected, a curvature is imparted to it which follows the curvature of the control member 51. This induced curvature increases the potential energy of the carrier 53, thereby increasing the kinetic energy of the striker 55 when it is released and correspondingly increasing the acoustic output of the horn 20.

The manner in which this increase in acoustic output is achieved can better be understood by reference to FIG. 9, in which force is measured on the vertical axis and the distance between the bearing surfaces 35 and 57 is measured on the horizontal axis. Curve A is a plot of the static magnetic force between the striker 55 and the armature core 33. It can be seen that the curve A is nonlinear, indicating that the static magnetic force increases geometrically as the striker 55 approaches the core 33.

The prior art striker assembly of the type disclosed in the aforementioned U.S. Pat. No. 4,075,627 has a carrier spring, the cantilevered portion of which is substantially flat and is unencumbered during movement of the striker toward the electromagnet core. The static force/deflection relationship of this prior art carrier spring is represented by curve B in FIG. 9, and it can be seen that this relationship is essentially linear. The energy made available to the carrier spring by the magnetic circuit is represented by the area beneath the curve A. The portion of this energy which is stored by the carrier as potential energy and is thereby made available for the production of an acoustic output is represented by the area under the curve B. The area between the curves A and B represents the kinetic energy given to the striker when it is drawn toward the electromagnet core, and does not produce an acoustic output. It can be seen that this essentially wasted kinetic energy forms a large part of the energy made available by the magnetic circuit in the prior art device.

The static force/deflection relationship of the carrier 53 of the present invention is represented by the curve C. In can be seen that the curve C is nonlinear and substantially follows the magnetic force curve A. The area beneath the curve C represents the potential energy stored in the carrier 53 and available for producing acoustic output. This is a much greater percentage of the available energy from the magnetic circuit than in the prior art device. Thus, it can be seen that a fundamental aspect of the present invention is the creation of a carrier characteristic which tends to follow the magnetic force curve, thereby increasing the potential energy stored in the carrier, and increasing the acoustic output to provide a much more efficient electric horn. The unique control means of the present invention effectively converts wasted kinetic energy into potential energy which is ultimately used to produce an acoustic output.

Another important advantage of the present invention is afforded by the inclined bearing surface 35 of the core 33. Thus, it will be appreciated that the upper end of the bearing surface 35 is in close proximity to the striker 55 in its rest position, while at the same time the slope of the bearing surface 35 is so designed as to accommodate the curvature imparted to the carrier 53 by the control member 51 when the striker 55 is deflected toward the electromagnet 30, the bearing surfaces 35 and 37 being substantially parallel at the point of greatest deflection of the striker 55 toward the electromagnet 30. This construction serves to reduce the starting voltage for the horn 20 while accommodating the controlled deflection of the carrier 53 to maximize the potential energy stored therein. This result could also be achieved by constructing the striker 55 so that the bearing surface 57 thereof slopes downwardly to the right, as viewed in FIG. 2, but it has been found that in order to maximize control, it is preferred that the sloping surface be formed on the core 33.

Figure 4:
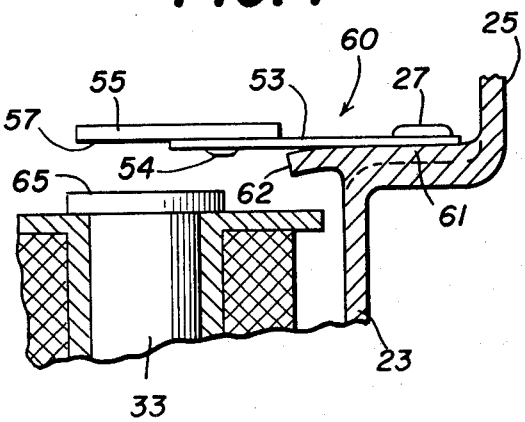
FIG. 4 is a further enlarged fragmentary view in vertical section of an electric horn incorporating a second embodiment of the present invention.

Referring now to FIG. 4 of the drawings, there is illustrated an alternative form of striker assembly, generally designated by the numeral 60, which is substantially similar to the striker assembly 50, with the exception that in place of the control member 51, there has been provided a flange 61 integral with the housing shelf 24 and having a curved distal end 62 projecting radially inwardly of the lower section 23 of the housing 21. It will also be noted that in the embodiment of FIG. 4, the electromagnet core 33 has a flat horizontal bearing surface 65, although it will be appreciated that an inclined bearing surface 35 could also be provided, as in the embodiment of FIGS. 1 through 3.

In FIG. 6 there is disclosed another embodiment 80 of the striker assembly of the present invention, which is substantially similar to the embodiment of FIG. 2, with the exception that a control member 81 has been substituted for the control member 51. The control member 81 has a stepped configuration, including a top step or attachment surface 82 secured to the carrier 53, a second step 83 spaced a slight distance from the carrier 53 and a third step 84 spaced a further distance from the carrier 53. The steps of the control member 81 are arranged to simulate a curved surface. Thus, as the striker 55 is drawn toward the electromagnet core 33, the carrier 53 sequentially engages the steps 83 and 84, thereby to impart to the carrier 53 a curvature which is a simulation of the curvature imparted by the control member 51. In FIG. 6 there is an alternative form of the striker assembly 80, in which there is provided a control member 85 having an attachment surface 86 and a single step 87. The control member 85 provides a less close approximation of the curvature imparted by the control member 51, than does the control member 81.

In FIG. 7 there is disclosed still another form of striker assembly, generally designated by the numeral 90. The striker assembly 90 is characterized by the fact that the housing shelf 24 is modified to provide a downwardly and inwardly sloping control surface 91 thereon. There is also provided an elongated carrier member 93 which is dimensioned to span the electromagnet 30, with the opposite ends of the carrier member 93 being respectively loosely rested upon the control surface 91 at diametrically opposed points thereon. Fixedly secured to the underside of the carrier member 93 centrally thereof is a striker 95. As the striker 95 is drawn toward the electromagnet 30, the carrier 93 is deflected to bring more of the end portions thereof progressively into engagement with the control surface 91, the extent and slope of the control surface 91 being such as to impart the desired curvature to the carrier 93.

In FIG. 8 there is illustrated a striker assembly 100 which uses an alternative form of the floating carrier of FIG. 7. More specifically, the striker assembly 100 has a carrier 103 having a circular striker 105 fixedly secured to the undersurface thereof and being provided with three radially outwardly extending and equiangularly spaced-apart arms 106, 107 and 108, respectively resting upon the control surface 91. There is also provided a pair of posts 109 respectively extending upwardly from the control surface 91 on opposite sides of the channel 29. The carrier 103 will tend to rotate as it vibrates and the posts 109 will prevent the arms 107 and 108 from falling into the channel 29. It will be appreciated that similar posts may be provided in the embodiment of FIG. 7.

While in the embodiments of FIGS. 4 through 6 the electromagnet core 33 has been illustrated as having a flat horizontal bearing surface 65, it will be appreciated that an inclined bearing surface 35 could be provided in each of these embodiments. Furthermore, it should be recognized that if the control flange 61 and the control members 51, 81 and 85 are formed of the proper material, they will reduce the reluctance between the striker 55 and the housing 21, thereby improving the magnetic circuit of the horn 20.

From the foregoing, it can be seen that there has been provided an improved electric horn with a unique control means for the striker assembly which maximizes the efficiency of the horn and is adapted for cooperation with the electromagnet core to minimize the starting voltage thereof.

What is claimed is:

1. An improved horn for generating an audible signal comprising a housing formed of magnetically permeable material and being open at one end thereof, a diaphragm of relatively flexible material at said one end and attached to said housing, an electromagnet in said housing and attached thereto and spaced from said diaphragm, a control member immovably carried by said housing and projecting inwardly therefrom, a resilient flexible carrier member supported by said housing adjacent to and engageable with said control member, and a striker member of magnetically permeable material mounted on said carrier member between said electromagnet and said diaphragm and operatively associated with said electromagnet for movement away from and strikingly against said diaphragm to generate noise, said carrier member engaging said control member along an increasing area of said carrier member during movement of said carrier member away from said diaphragm for imparting to said carrier member a predetermined curvature for increasing the potential energy thereof.

2. The horn of claim 1, wherein said control member is integral with said housing laterally outwardly of said electromagnet and projects from said housing toward said electromagnet.

3. The horn of claim 1, wherein said control member is secured between said housing and said carrier member laterally outwardly of said electromagnet, said control member having a curved distal end projecting toward said electromagnet and engageable with said carrier along an increasing area of said carrier member during movement of said carrier member away from said diaphragm for imparting to said carrier member said predetermined curvature.

4. The horn of claim 1, wherein said control member is secured between said housing and said carrier member, said control member having a plurality of steps thereon disposed for sequential engagement with said carrier member during movement of said carrier member away from said diaphragm for imparting to said carrier member said predetermined curvature.

5. An improved horn for generating an audible signal comprising a housing formed of magnetically permeable material and being open at one end thereof, a diaphragm of relatively flexible material at said one end and attached to said housing, an electromagnet in said housing and attached thereto and spaced from said diaphragm, said electromagnet including a core with a substantially planar bearing surface thereon facing said diaphragm and inclined with respect to the axis of said core, a control member immovably carried by said housing and having a curved distal end projecting inwardly from said housing toward said electromagnet, a resilient flexible carrier member supported by said housing adjacent to and engageable with said control member, a striker member of magnetically permeable material mounted on said carrier member between said electromagnet and said diaphragm and operatively associated with said electromagnet for movement away from and strikingly against said diaphragm to generate noise, said striker member having a bearing surface thereon facing said bearing surface of said electromagnet core, said bearing surfaces being inclined with respect to each other when said carrier member is disposed in the normal rest position thereof, said control member cooperating with said carrier member when said striker member moves away from said diaphragm for imparting to said carrier member a predetermined curvature for increasing the potential energy thereof, said control member controlling the movement of said striker member so that said bearing surfaces are disposed substantially parallel at the point of greatest displacement of said striker member toward said electromagnet core.

* * * * *